US010287726B2

(12) United States Patent
Chua

(10) Patent No.: US 10,287,726 B2
(45) Date of Patent: May 14, 2019

(54) GARMENT STEAMER

(71) Applicant: KONINKLIJKE PHILIPS N.V., Eindhoven (NL)

(72) Inventor: Hee Keng Chua, Singapore (SG)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 335 days.

(21) Appl. No.: 14/366,998

(22) PCT Filed: Dec. 22, 2012

(86) PCT No.: PCT/IB2012/057658
§ 371 (c)(1),
(2) Date: Jun. 19, 2014

(87) PCT Pub. No.: WO2013/098756
PCT Pub. Date: Jul. 4, 2013

(65) Prior Publication Data

US 2014/0345334 A1 Nov. 27, 2014

(30) Foreign Application Priority Data

Dec. 27, 2011 (EP) ..... 11195737

(51) Int. Cl.
*D06F 73/00* (2006.01)
*D06F 75/00* (2006.01)
*D06F 87/00* (2006.01)

(52) U.S. Cl.
CPC ..... *D06F 87/00* (2013.01); *D06F 73/00* (2013.01); *D06F 75/00* (2013.01); *F04C 2270/0421* (2013.01)

(58) Field of Classification Search
CPC ..... D06F 73/00; D06F 87/00
See application file for complete search history.

(56) References Cited

U.S. PATENT DOCUMENTS

| | | | |
|---|---|---|---|
| 2,616,194 | A | 11/1952 | Terwelp |
| 3,581,529 | A | 6/1971 | Bernard |
| 6,886,373 | B2 | 5/2005 | Carrubba |
| D540,498 | S | 4/2007 | Tobias |
| 2005/0150261 | A1 | 7/2005 | Carlucci |

(Continued)

FOREIGN PATENT DOCUMENTS

| | | | |
|---|---|---|---|
| CN | 2145025 | Y | 11/1993 |
| CN | 2399429 | Y | 10/2000 |

(Continued)

*Primary Examiner* — Spencer E Bell

(57) ABSTRACT

A steam head for a garment steamer includes a handle, and a steam duct having an upstream end connectable to a steam hose and a downstream end that defines a steam ejection opening with a circumferential edge that forms a frontal contact surface. A surface area of the frontal contact surface is smaller than an area of the steam ejection opening. The steam head further includes a drainage tube extending between condensate inlet and outlet ends, where the condensate inlet end is disposed within a downstream portion of the steam duct while the condensate outlet end is disposed elsewhere, such as connected to a water reservoir or a boiler of the garment steamer, or to a dedicated condensate collector.

8 Claims, 5 Drawing Sheets

(56) References Cited

U.S. PATENT DOCUMENTS

| | | | | |
|---|---|---|---|---|
| 2006/0188239 | A1* | 8/2006 | Carlucci | A47L 25/00 392/403 |
| 2008/0034813 | A1* | 2/2008 | Tobias | D06F 87/00 68/222 |
| 2008/0168688 | A1* | 7/2008 | Hahn | D06F 75/10 38/77.8 |
| 2010/0083532 | A1* | 4/2010 | Klug | D06F 39/022 34/597 |
| 2010/0168599 | A1 | 7/2010 | Esposito | |
| 2011/0173848 | A1* | 7/2011 | Lin | D06F 87/00 38/14 |

FOREIGN PATENT DOCUMENTS

| | | | |
|---|---|---|---|
| CN | 2538833 | Y | 3/2002 |
| CN | 2597513 | Y | 12/2002 |
| CN | 2835317 | Y | 11/2006 |
| CN | 201050018 | Y | 4/2008 |
| CN | 201103068 | Y | 8/2008 |
| CN | 101581030 | A | 11/2009 |
| CN | 201473804 | U | 5/2010 |
| CN | 201669240 | U | 5/2010 |
| CN | 201883320 | U | 9/2010 |
| EP | 2213781 | A1 | 4/2010 |
| FR | 2916004 | A1 | 5/2007 |
| WO | 2008005907 | A2 | 1/2008 |
| WO | 2008021580 | A1 | 2/2008 |
| WO | 2011055250 | A2 | 5/2011 |

* cited by examiner

GARMENT STEAMER

This application is the U.S. National Phase application under 35 U.S.C. § 371 of International Application No. PCT/IB2012/057658, filed on Dec. 22, 2012 which claims benefit of European Patent Application No. 11195737.9, filed Dec. 27, 2011. This application is hereby incorporated by reference herein.

FIELD OF THE INVENTION

The present invention relates to the field of garment steamers, and more in particular to a garment steamer including a generally stationary base comprising a boiler that, by means of a steam hose, is operatively connected to a hand-held steam head.

BACKGROUND OF THE INVENTION

Garment steamers are known in the art. See, for instance, U.S. D 540,498-S, which discloses an ornamental design for a garment steamer, and CN 2010/50018Y.

A garment steamer provides a convenient way of removing wrinkles from fabrics, in particular garments. The device may normally include a hand-held steam head from which steam is releasable, and that, during use, may be run up and down a garment hanging from a hanger or the like, at a slight distance therefrom or in grazing contact therewith. The steam fed to the garment induces stress relaxation, which, in particular under the action of light manual stretching, smoothes out any creases therein.

Non-portable garment steamers may include a steam supplying stand or base, accommodating a water reservoir and a steam generator or boiler, that is connected to the steam head via a steam hose. During operation, liquid water from the water reservoir may be fed to the boiler to heat and vaporize it, such that steam may subsequently be supplied to the steam head via the steam hose. Such garment steamers come in two basic types: those whose steam head includes heating means, and those whose steam head does not.

The type of garment steamer with secondary heating means in the steam head may typically generate its steam in a 'closed' boiler in which steam may be pressurized, and from which high-pressure, high-temperature steam discharge into the steam hose may be controlled by an electrovalve that is user-operable via a switch on the steam head. Any condensate produced when the steam passes the (relatively long and cold) steam hose is re-evaporated by the heating means in the steam head before discharge of the steam onto the garment. Furthermore, the heated steam head also prevents steam that is reflected off of the garment and back onto the steam head from condensing thereon, and hence from being brushed off onto the garment as the steam head is run past it in close contact. This way the heating means in the steam head precludes the formation of wet spots on the garment.

More economical to manufacture, but also more prone to the issue of wet spots is the type of garment steamer without secondary heating means in the steam head. A steamer of this type may typically generate its steam in an 'open' boiler or kettle. Water may flow from the water reservoir into the boiler without the aid of a pump, but simply under the pressure of the water head, and subsequently into the steam hose for release from the steam head. Hence steam may be produced and released as long as water is present in the system. The pressure and temperature of the generated steam may be lower than those of garment steamers with a closed boiler, which increases the chance of condensation (in particular in the steam hose and steam head). Due to the lack of heating means in the steam head, however, there is no way of re-evaporating condensate before the point of steam release. The condensate may therefore be spit out of the steam head's steam passages onto a garment to cause wet spots. In addition, steam that bounces off a garment, back onto the steam head, cannot be kept from condensing thereon. The risk that accumulated condensate is wiped off on the garment being treated is thus increased further.

SUMMARY OF THE INVENTION

It is an object of the present invention to provide for an improved steam head. The invention is defined by the independent claims. The dependent claims define advantageous embodiments.

An embodiment of the invention provides a garment steamer that, even when it is used without internal, secondary heating means, mitigates or overcomes the issue of wet spots on garments being treated.

An embodiment of the present invention provides an economically manufacturable garment steamer that overcomes or mitigates the issue of wet spot formation on garments being treated.

An embodiment of the present invention provides an economically manufacturable garment steamer accessory that is detachably connectable to a steam head of a conventional garment steamer so as to overcome or mitigate wet spot formation during operation.

A first aspect of the present invention is directed to a steam head for a garment steamer. The steam head may comprise a handle, and a steam duct. The steam duct may extend through the handle or be otherwise connected thereto, and have an upstream portion with an upstream end that is configured to be connected to a steam hose, and a downstream portion with a downstream end that defines a steam ejection opening. The steam head may further have a frontal contact surface that is at least partially provided for by a circumferential edge of the steam ejection opening, and that is configured to be in grazing contact with a garment when releasing steam from the steam ejection opening onto the garment during use, which frontal contact surface may have a surface area that is smaller than an area of the steam ejection opening. The steam head may also comprise a drainage tube that extends between a condensate inlet end and a condensate outlet end. The condensate inlet end may be disposed within the downstream portion of the steam duct while the condensate outlet end may be disposed elsewhere, for instance connected to a water reservoir or boiler of the garment steamer or a dedicated condensate collector.

In a conventional steam head, steam passages may typically be provided in a large, generally flat frontal surface of the steam head. During use, this surface may be oriented to face the garment being steamed and be brought into grazing contact therewith to apply the steam from the steam passages to the garment. Condensate may thereby drip from the steam passages and trickle along the frontal surface, until it is wiped off onto the garment to form wet spots. Alternatively, it may be spit out of the steam passages with the same effect. Furthermore, in particular due to a lack of secondary heating means in the steam head, the frontal surface may be relatively cold and cause steam that is released from the steam passages and subsequently reflected off of the garment, back onto the surface, to condense thereon. Again, the condensate is likely to be wiped off on the garment, thereby giving rise to more undesirable wet spot formation. The present invention is partly based on the understanding that a large frontal surface area adversely contributes to wet spot formation as described. It addresses the problem by providing the steam head with a relatively small frontal contact surface. In this text, the term 'frontal contact surface' may be construed to mean the surface (portions) of the steam head that may be brought into physical contact with a (generally planar patch of) garment during normal use of the device, in particular when the steam ejection opening of the steam duct is held to the garment as close as possible. Various portions of the frontal contact surface may typically lie in approximately the same plane.

To enable the targeted delivery of steam to the garment, the steam head may be configured such that the downstream end of the steam duct may be brought into direct, physical contact with a garment. A circumferential edge of the steam ejection opening at the downstream end of the steam duct may provide for at least a part, and possibly the entire, frontal contact surface area of the steam head. In a preferred embodiment, the downstream end of the steam duct defines precisely one steam ejection opening from which all steam leaving the steam head is released. In an alternative embodiment, however, the downstream end of the steam duct may define multiple neighboring steam ejection openings. Where two or more of these steam ejection openings share a circumferential edge, the term 'circumferential edge of the steam ejection opening' may be construed to include these shared circumferential edge portions.

In a preferred embodiment, the surface area of the frontal contact surface may be less than 10%, and more preferably less than 5%, of the (cross-sectional) area of the steam ejection opening, which may typically form a measure for the amount of steam to be released. The smaller the frontal contact surface, the smaller the opportunity for condensation of reflected steam thereon, or more generally, for condensate to reside on the frontal contact surface. This means that the formation of wet spots via the transfer of condensate off the contact surface onto the garment is minimized. A smaller contact surface is also gentler to garments as it reduces wear during grazing contact.

During use, condensate may accumulate inside the steam duct, either due to condensation of steam that is transported downstream, or due to the capture and subsequent condensation of steam that is reflected off of the garment. To prevent condensate from leaking from the downstream end of the steam duct, at least a part of the downstream portion of the steam duct may have an inner cross-sectional area (normally taken perpendicular to an average steam transport direction) that decreases in the downstream direction, towards the steam ejection opening. Accordingly, the steam duct may be considered to bend or curve inwards, such that the downstream end of the downstream portion may form an upwardly sloping wall that prevents the leaking or outflow of condensate from the downstream end when at least the downstream portion of the steam duct is kept in an approximately horizontal orientation.

To enable accumulating condensate to be drained from the downstream side of the partition, the steam head may comprise a drainage tube that extends between a condensate inlet end and a condensate outlet end, wherein said condensate inlet end is disposed in, or at least in fluid connection with, the downstream portion of the steam duct, downstream of the partition, while the condensate outlet end is disposed elsewhere, i.e. outside of the downstream portion of the steam duct.

The drainage tube may serve to prevent the accumulation of condensate within the downstream portion of the steam duct, and facilitate the controlled discharge thereof to another location, e.g. by putting the condensate outlet end of the drainage tube in fluid communication with a water reservoir that feeds the garment steamer, a boiler, or a separate, dedicated condensate collector. The condensate inlet of the drainage tube may preferably be disposed at a normally lowest point within the downstream portion of the steam duct. Here 'normally' refers to a 'normal use orientation', which may be construed to mean the primary or typical orientation in which the steam head is configured to be held during operation, in particular during a plain up and down motion along a hanging garment. In one embodiment, the steam head may be configured such that it has a normal use orientation in which the steam duct is defined by an upper wall portion and a lower wall portion, and the condensate inlet end of the drainage tube may be disposed adjacent the lower wall portion, preferably adjacent a partition.

In one embodiment of the steam head, at least the downstream portion of the steam duct may be at least partially transparent. An inner surface of the transparent parts of the downstream portion may preferably be coated with a (super) hydrophobic coating. In such an embodiment, the downstream portion of the steam duct may resist steaming up and enable a user to visually inspect the area of the garment being treated.

In another embodiment of the steam head, the steam duct may be provided with a partition, disposed in between the upstream end and the downstream end thereof, wherein said partition defines at least one steam passage. In this context, a partition may be construed to include a dividing wall, a notable constriction and the like. The partition may serve to define one or more steam passages that enable the downstream flow of steam while preventing the upstream movement of foreign objects, e.g. garment buttons that may accidentally come off a garment being steamed, and that may clog the steam duct or the steam hose.

Steam passages in the partition may cause steam to condensate therein, which condensate may then, under the build-up of steam pressure upstream thereof, be forcefully spit out onto a garment being treated. To prevent this, the steam passages/the partition may preferably be disposed at least 2 cm, and more preferably at least 3 cm, upstream of the steam ejection opening of the downstream end of the steam duct. The distance ensures that, under typical conditions, small spit out condensate droplets are intercepted by the wall of the downstream portion of the steam duct before they reach the garment being steamed. In addition, the length may be desirable to provide the downstream portion of the steam duct with a sufficient and smoothly inward bend/curvature to avoid spilling of collected condensate, and to enable the (re-)homogenization of the steam flow downstream of the partition/steam passages. The latter effect ensures a homogeneous steam application to the garment.

In one embodiment, the at least one steam passage may include/the partition may define multiple discrete, macroscopic steam passages, orderly arranged relative to each other. In another embodiment the partition may be at least partly made of a porous material, defining a plurality of approximately microscopic steam passages. Such a partition offers the advantage that it enables the downstream flow of steam, and prevents the upstream movement of foreign objects while still allowing for the upstream flow of condensate through the porous partition. Accordingly, condensate may be fed back into a steam hose connected to the upstream end of the steam duct, and so back to a boiler for re-evaporation.

In case the steam duct includes a partition in the form of a dividing wall with one or more centrally arranged, macroscopic steam passages, the partition may block the back flow of condensate into the steam hose. This arrangement may occur in particular when a conventional steam head, having a front facing head plate with a plurality of steam passages, is retrofitted with a steam ejection sleeve to define a new downstream portion of the steam duct, as will be described in more detail below. Any accumulating condensate may then be drained from the downstream side of the partition by means of the aforementioned drainage tube that extends between a condensate inlet end and a condensate outlet end, wherein said condensate inlet end is disposed in, or at least in fluid connection with, the downstream portion of the steam duct, downstream of the partition, while the condensate outlet end is disposed elsewhere, i.e. outside of the downstream portion of the steam duct.

A second aspect of the present invention is directed to a garment steamer. The garment steamer may comprise a steam head including a drainage tube according to the first aspect of the present invention. It may further comprise a base, accommodating a water reservoir having a water supply opening and a water discharge opening, and a boiler having a water supply opening and a steam discharge opening, wherein the water supply opening of the boiler may be connected to the water discharge opening of the water reservoir. The garment steamer may also comprise a steam hose, having a first end connected to the steam discharge opening of the boiler and a second end connected to the steam head. The condensate outlet end of the drainage tube may be fluidly connected to at least one of the water reservoir and the boiler, such that condensate that accumulates in the downstream portion of the steam duct may drain back therein.

To prevent an entanglement prone two-tube-connection between the steam head and the base of the garment steamer, the steam hose and the drainage tube may be accommodated in and run in parallel within a uni-strand cord that extends between the steam head and the base.

Although the above-described features may be integrated into a steam head upon manufacture, it is contemplated that they may alternatively be applied to conventional steam heads in the form of an accessory with corresponding effects.

A third aspect of the present invention is therefore directed to an accessory for a steam head of a garment steamer, which steam head may include a handle and a steam duct. The steam duct may extend through the handle or be otherwise connected thereto, and have an upstream portion with an upstream end that is configured to be connected to a steam hose, and with a downstream end defined by a head plate including at least one steam passage. The accessory may comprise a steam ejection sleeve that is detachably connectable to the steam head of the garment steamer such that, in a connected state, the sleeve circumferentially encloses the at least one steam passage in the head plate so as to form an extension of the steam duct and to define a downstream portion of said steam duct with a downstream end that defines a steam ejection opening. A circumferential edge of said steam ejection opening may provide for at least part of a frontal contact surface that is configured to be in grazing contact with a garment when releasing steam from the steam ejection opening onto the garment during use, and a surface area of the frontal contact surface may be smaller than an area of the steam ejection opening. The accessory may also include a drainage tube that extends between a condensate inlet end and a condensate outlet end, wherein said condensate inlet end is disposed within the steam ejection sleeve while the condensate outlet end is disposed elsewhere.

The accessory's steam ejection sleeve may be provided with a drainage tube. Connecting the condensate outlet end thereof to a water inlet end of a water reservoir in a base of a garment steamer may be awkward, however, in particular because it yields an entanglement prone two-tube-connection between the steam head and the base. This undesirable configuration may be prevented by an accessory that comprises a dedicated condensate collector that is detachably connectable to a steam hose of the garment steamer, which condensate collector defines a condensate reservoir that is connected to the condensate outlet end of the drainage tube, such that condensate can flow from the steam ejection duct into the condensate reservoir.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
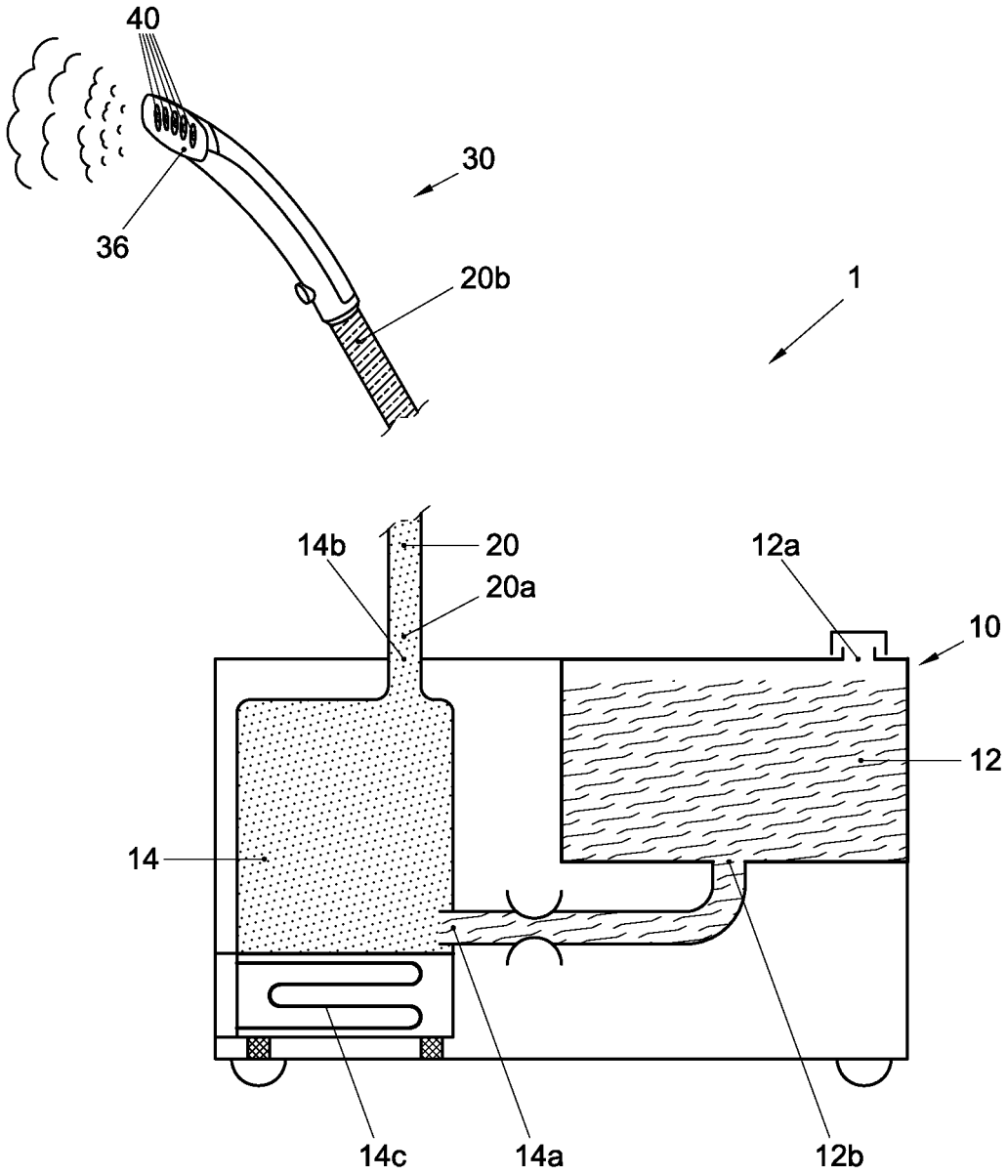
FIG. 1 is a schematic cross-sectional side view of a conventional garment steamer.

FIG. 1 is a schematic cross-sectional side view of a conventional garment steamer 1. The garment steamer 1 includes a base 10, a hand-held steam head 30, and a flexible, thermally insulated steam hose 20 interconnecting the two. The base 10 accommodates a water reservoir 12 with a closeable water supply opening 12*a* via which the reservoir may be refilled. A water discharge opening 12*b* of the water reservoir 12 is fluidly connected to the water supply opening 14*a* of an open kettle-type boiler 14 that is also accommodated by the base 10, and powered by an electric heating element 14*c*. A steam discharge opening 14*b* of the boiler 14 is connected to a first end 20*a* of the steam hose 20, while a second end 20*b* thereof is connected to the steam head 30. The steam head includes a generally flat, front-facing head plate 36 that defines a plurality of spaced apart steam outlet passages 40. During operation, the water head in the water reservoir 12 causes the flow of water from the water reservoir into the boiler 14. The boiler 14 evaporates the supplied water and discharges it as steam via the steam hose 20 to the steam head 30, which subsequently releases it through the corresponding steam passages 40.

It was already mentioned above that the pressure and temperature of steam generated in a garment steamer of the type depicted in FIG. 1 may be lower than those of steam from garment steamers with a closed, pressurized boiler, and that this may increase the chance of condensation (in particular in the steam hose 20 and steam head 30). Due to the lack of heating means in the steam head 30, condensate cannot be re-evaporated before reaching the steam passages 40. Consequently, the condensate may temporarily clog the steam passages 40 and, under the build-up of steam pressure upstream thereof, be spit out of onto a garment being treated, thereby causing wet spots. In addition, steam that bounces off the garment, back onto the steam head 30, cannot be kept from condensing on the relatively large external surface of the head plate 36. This brings the risk that accumulated condensate will be wiped off on the garment being treated, which could cause even larger wet spots.

Figure 2:
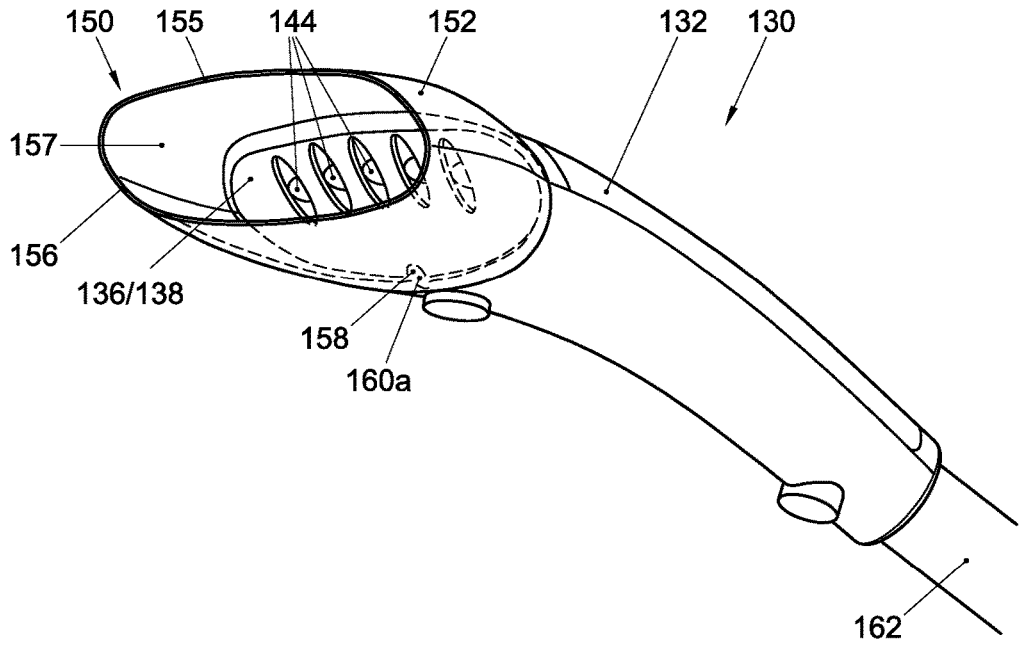
FIG. 2 is a schematic perspective view of a first exemplary embodiment of a steam head according to the present invention.
Figure 3:
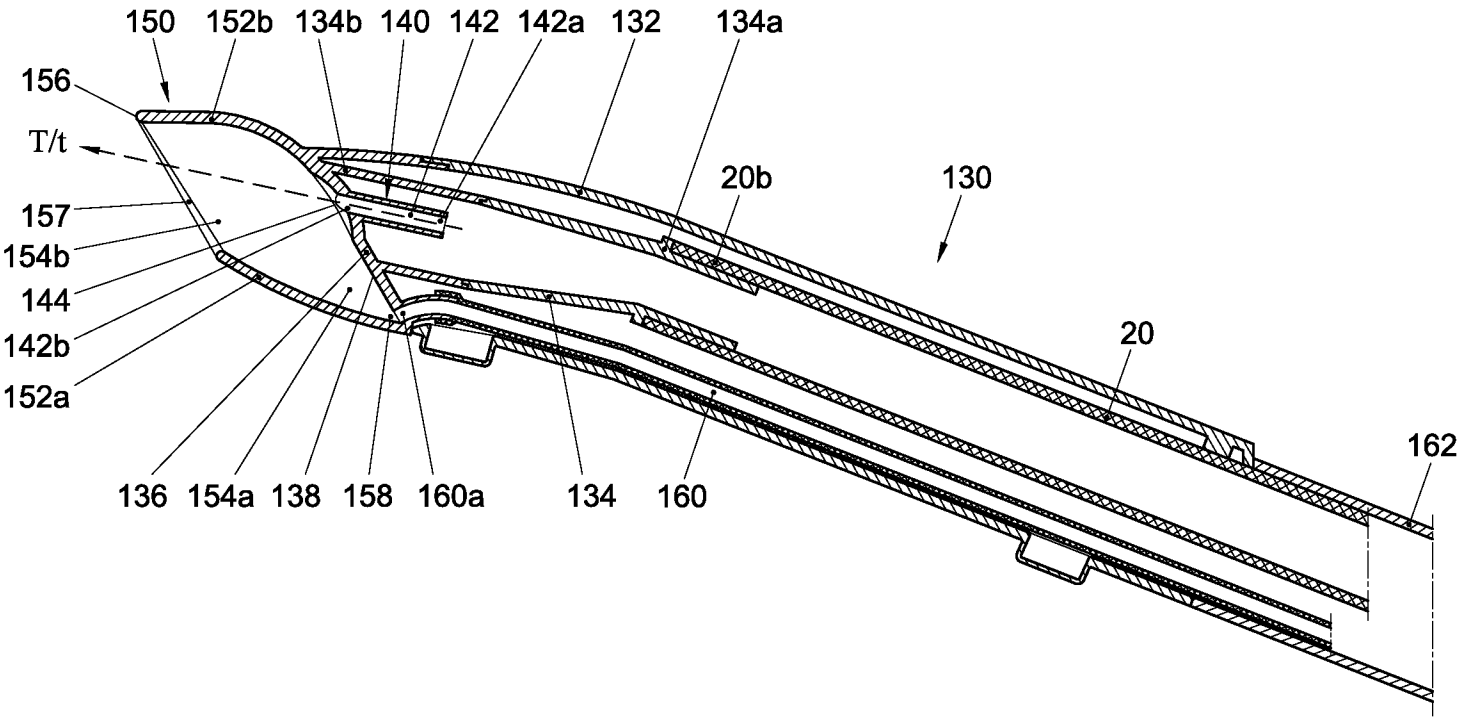
FIG. 3 is a schematic cross-sectional side view of the steam head shown in FIG. 2.

FIGS. 2 and 3 respectively illustrate a perspective view and a cross-sectional side view of a first exemplary embodiment of a steam head 130 according to the present invention that overcomes or at least mitigates the problem of wet spots associated with the conventional steam head 30 shown in FIG. 1. The steam head 130 may be used in combination with a conventional base 10, and if desired, a conventional steam hose 20. It is noted that both figures show the steam head 130 in its normal use orientation, i.e. the primary orientation in which the steam head is configured to be held during operation, in particular during plain up and down movement along a hanging garment. In the normal use orientation of the steam head 130, a steam hose 20 may typically connect to/extend from a lowest point of the steam head 130, while the average steam ejection direction T of the steam passages 140 (see below) may typically include an angle less than 45 degrees with the horizontal.

As can be seen in FIGS. 2 and 3, the steam head 130 according to the present invention may have an at least partially double-tubed structure. The outer tube of the structure may provide for a generally elongate hollow handle 132 for gripping by a user, while the inner tube may provide for an upstream portion 134 of a steam duct. The upstream portion 134 of the steam duct may extend over an entire length of the handle 132, or over a portion thereof (as shown). A first, upstream end 134*a* of the upstream portion 134 of the steam duct may be dimensioned to be connectable to the second, downstream end 20*b* of a steam hose 20 of a garment steamer. A second, downstream end 134*b* of the upstream portion 134 of the steam duct may be defined by a partition 136 that extends generally radially to connect to the corresponding end of the handle 132, and that is provided with a plurality of spaced apart steam passages 140 in its center area. Each steam passage 140 may include a steam guide 142, for instance in the form of a relatively small-diameter tube, a first, upstream end 142*a* of which may reside in the upstream portion 134 of the steam duct and a second, downstream end 142*b* of which may coincide with a steam outlet opening 144 of the steam passage 140 in the partition 136. Each of the steam guides 142 of the plurality of steam passages 140 may be generally straight and extend in a respective steam ejection direction t. The respective steam guides 142 may preferably extend in parallel to define a common steam ejection direction, but at any rate their (vector) average defines an average steam ejection direction T.

The steam head 130 according to the present invention may comprise a steam ejection sleeve 150. The steam ejection sleeve 150 may include a sleeve wall 152 that is connected to a peripheral area of the external surface 138 of the partition 136 and that protrudes therefrom, such that it circumferentially encloses the plurality of steam passage openings 144 in its center area. Seen in the average steam ejection direction T, the sleeve wall 152 may extend beyond the steam passage openings 144 of the steam passages 140 in the partition 136, preferably by at least 2 cm, and more preferably at least 3 cm. The sleeve wall 152 may thus define a downstream portion of the steam duct of the steam head 130; accordingly, the terms 'steam ejection sleeve' and 'downstream portion of the steam duct' may be used interchangeably. The sleeve wall 152 may extend between a fixed first end 154*a* that is proximal to the steam passage openings 144 of the steam passages 140 and a free second end 154*b* that is distal to the steam passage openings 144. The second end 154*b* may define a steam ejection opening 157 from which steam may ultimately be released. The thickness of the sleeve wall 152 may be small, e.g. less than 5 mm and preferably less than 2.5 mm, such that the circumferential edge of the sleeve wall 152 defining the steam ejection opening 157 at the second end 154*b* of the steam duct 154 forms a protruding frontal contact surface 156 with a significantly smaller surface area than that of the recessed, external partition surface 138 in which the steam passages 140 are provided. Compared to the conventional steam head of FIG. 1, the presently disclosed steam head 130 thus offers less opportunity for condensation of reflected steam due to the fact that the area of the frontal contact surface 156 is significantly smaller than that of the head plate 36 (which is structurally comparable to the partition 136 in the illustrated embodiment). In general, the surface area of the frontal contact surface 156 may be smaller than an area of the steam ejection opening 157, and preferably amount to less than 10% thereof, to minimize the formation of wet spots via the transfer of condensate off the frontal contact surface 156 onto the garment. Reflected steam may, of course, re-enter the steam ejection sleeve 150, i.e. the upstream portion of the steam duct, to condense on the inner surface of the sleeve wall 152, but this presents no wet spot risk; such condensate may be drained from the upstream portion of the steam duct in a manner to be described below. The same applies to condensate that is spit out from the steam passages 140 and caught or intercepted by the steam ejection sleeve 150.

As regards its shape, the sleeve wall 152 may have a central extrusion axis, for example parallel to the average steam ejection direction T, along which its cross-sectional profile is projected. Alternatively, the cross-sectional profile of the sleeve wall 152 may vary along the average steam ejection direction T. In the embodiment depicted in FIGS. 2 and 3, for example, the steam ejection sleeve 150 has a gradually narrowing inner cross-section in the average steam ejection direction T, much like a nozzle. At least near the free second end 154*b* of the steam ejection sleeve 150, the lower and upper sleeve wall portions 152*a*, 152*b* bend somewhat towards each other. In the depicted normal use orientation this entails that the lower sleeve wall portion 152*a* curves upwards to provide a drainage slope that traps condensate at the fixed end of the lower sleeve wall portion 152*a*, which defines the normally lowest point 158 of the upstream portion of the steam duct.

In order to prevent the unrestrained accumulation of condensate in the upstream portion of the steam duct up to the point of running over, the partition 136 may be made of a porous material. The porous material may, for instance, take the form of a mesh, an open cell sponge structure, or a fabric (woven or non-woven), so as to enable the backflow of condensate from the downstream portion 150 of the steam duct into the upstream portion 134 thereof. Alternatively, the steam head 130 may be provided with a drainage tube 160. The drainage tube 160 may extend between a condensate inlet end 160*a* and a condensate outlet end 160*b*, shown in FIG. 4. The condensate inlet end 160*a* may be provided inside the steam ejection sleeve 150, preferably at the normally lowest point 158 of the steam duct, which may typically be located adjacent the lower sleeve wall portion 152*a* and adjacent the first end 154*a* of steam ejection sleeve 150. The condensate outlet end 160*b* may be connected to a water reservoir 12 or boiler 14 (not shown; cf. FIG. 1) that feeds, respectively powers the steaming process, or to a separate, dedicated condensate collector (see the discussion of the embodiment of FIG. 4).

The drainage tube 160 may be neatly and conveniently routed to the water reservoir in the base of the garment steamer by incorporating an upstream length portion thereof into the steam head's handle 132, and/or incorporating a downstream length portion thereof into a uni-strand cord 162 that also accommodates the steam hose 20. Hence, the steam head's handle 132 may accommodate, in parallel, both the upstream portion 134 of the steam duct (plus, optionally, its extension in the form of a downstream length portion of the steam hose 20) and the upstream length portion of the drainage tube 160. In between the steam head 130 and the base of the garment steamer, the drainage tube 160 and the steam hose 20 may run in parallel within the uni-strand cord 162, from a base end of which both may sprout again to connect to the (water supply opening of) the water reservoir and the steam discharge opening of the boiler, respectively.

Figure 4:
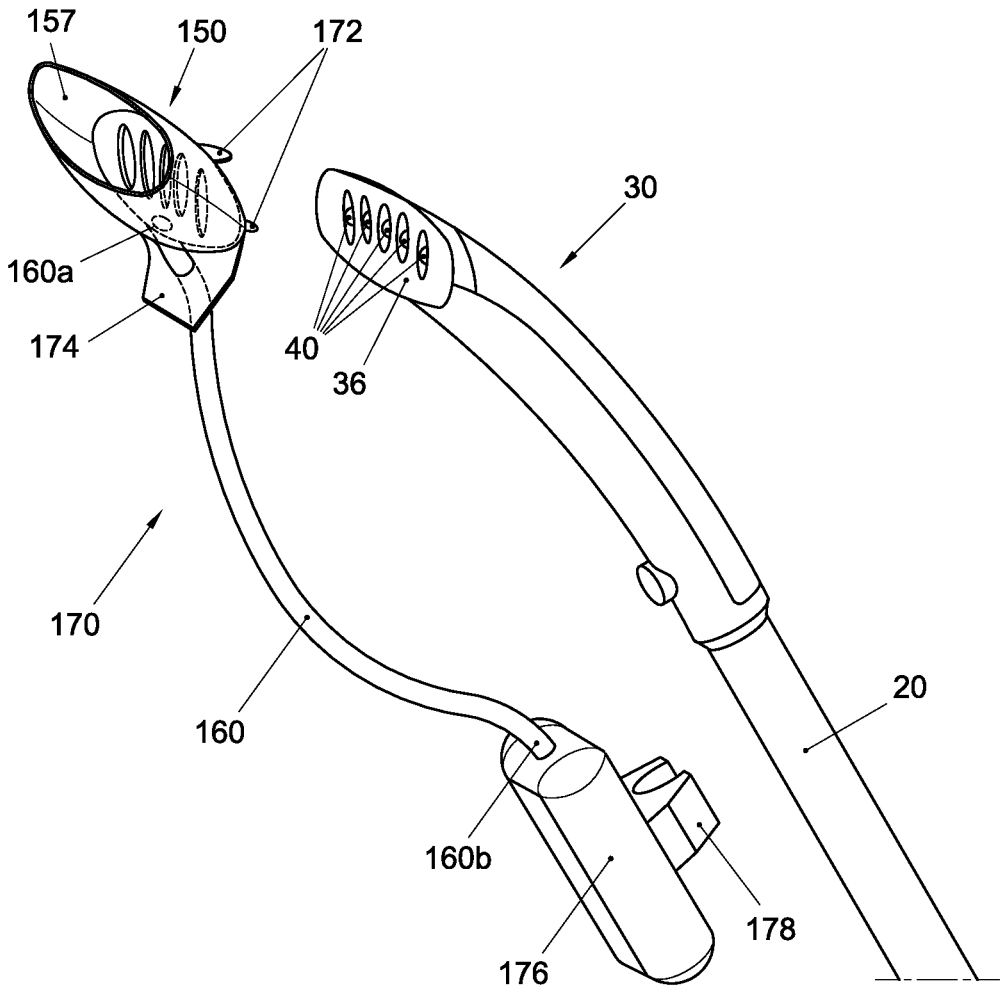
FIG. 4 is a schematic perspective view of a second exemplary embodiment of a steam head according to the present invention, configured as a clip-on accessory for conventional garment steamers.

Although the steam ejection sleeve 150 described above may be integrated with a steam head 130 upon manufacture, it is contemplated that it may alternatively be applied to conventional steam heads 30 as an accessory with corresponding effects. FIG. 4 schematically illustrates such an accessory 170, comprising a steam ejection sleeve 150, a drainage tube 160, and a condensate collector 176.

The steam ejection sleeve 150 of the accessory 170 may have a generally similar construction as that of the integrated steam ejection sleeve described above. In addition, it may be provided with at least one attachment provision 172, for example in the form of a suitable clip or clasp, that enables it to be detachably connected to a conventional steam head 30. The steam ejection sleeve 150 may also include a grip tab 174 to facilitate mounting of the steam ejection sleeve 150.

A condensate inlet end 160*a* of the drainage tube 160 may be connected to the steam ejection sleeve 150, such that it is in fluid communication with the interior of the steam ejection duct 154. A condensate outlet end 160*b* of the drainage tube 160 may in turn be connected to the condensate collector 176, such that it is in fluid communication with an internal condensate reservoir thereof. The condensate collector 176 may be provided with an attachment provision 176, for example in the form of a clip or clasp, that enables it to be detachably connected to a steam hose 20 of the conventional garment steamer that is being retrofitted with the accessory 170.

Figure 5:
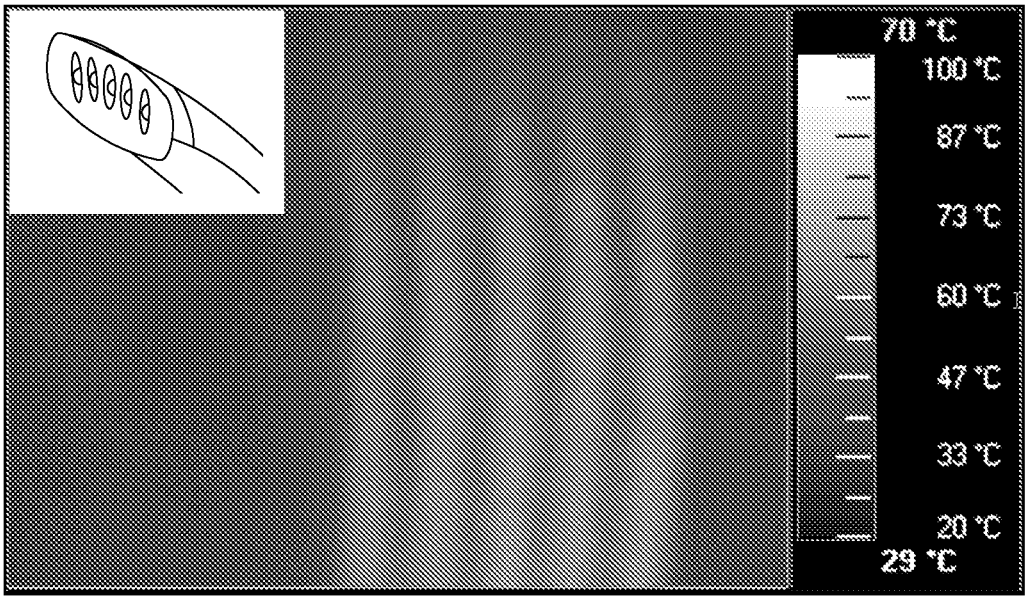
FIG. 5 schematically illustrates two heat distribution thermographs, one for a conventional steam head (top), and one for a steam head according to the present invention (bottom).
Figure 5:
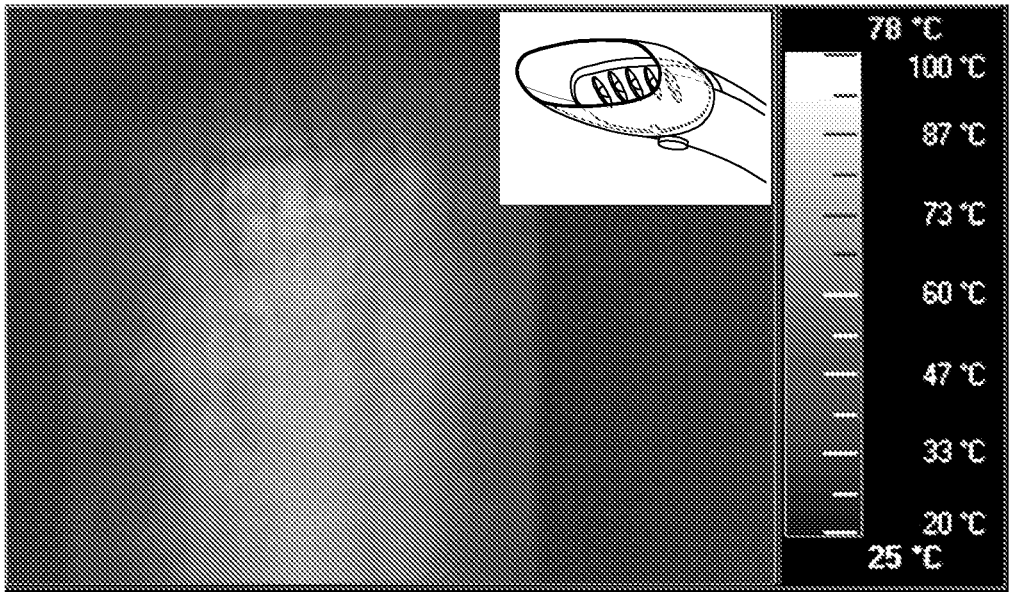

FIG. 5 schematically illustrates an additional advantage of the presently disclosed steam head. Tests have revealed that the steam ejection sleeve enables a more even application of heat and steam to a garment, resulting in better wrinkle removal. The graph on the top of FIG. 5 shows the heat distribution in a garment after it had been stroked with a conventional steam head including five spaced apart steam passages. The contribution of each of the steam passages is clearly traceable in the Figure, which indicates that in particular the areas in the garment corresponding to the areas in between the steam passages during the stroke may have been insufficiently treated. The graph on the bottom of FIG. 5 shows the heat distribution in a garment after it had been stroked with the same steam head, now provided with the above-described steam ejection sleeve accessory. The heat distribution is clearly smoother as no separate steam tracks associated with individual steam passages are visible.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In a device claim enumerating several means, several of these means may be embodied by one and the same item of hardware. The mere fact that certain measures are recited in mutually different dependent claims does not indicate that a combination of these measures cannot be used to advantage.

LIST OF ELEMENTS

1 conventional garment steamer
10 base
12 water reservoir
12*a* water supply opening
12*b* water discharge opening
14 boiler
14*a* water supply opening
14*b* steam discharge opening
14*c* electrically powered heating element
20 steam hose
20*a* first end
20*b* second end
30 conventional hand-held steam head
36 head plate of steam head
40 steam passage in head plate
130 hand-held steam head according to present invention
132 handle
134 upstream portion of steam duct
134*a* first, upstream end of upstream portion of steam duct
134*b* second, downstream end of upstream portion of steam duct
136 partition
138 external or outward facing surface of partition
140 steam passage (in partition)
142 steam guide
142*a* first, upstream end of steam guide
142*b* second, downstream end of steam guide
144 steam passage opening
150 steam ejection sleeve/downstream portion of steam duct
152 sleeve wall
152*a* lower portion of sleeve wall
152*b* upper portion of sleeve wall
154*a* first, upstream end of steam ejection duct
154*b* second, downstream end of steam ejection duct
155 circumferential edge
156 frontal contact surface
157 steam ejection opening
158 normally lowest point of upstream portion of steam duct
160 drainage tube
160*a* condensate inlet end
160*b* condensate outlet end
162 uni-strand cord
170 accessory
172 attachment provision
174 grip tab

176 condensate collector
178 attachment provision
t steam ejection direction of respective steam passage
T common or average steam ejection direction

The invention claimed is:

1. A steam head for a garment steamer, comprising:
a handle;
a steam duct, extending through or otherwise connected to the handle, having an upstream portion with an upstream end that is configured to be connected to a steam hose, and a downstream portion with a downstream end that defines a steam ejection opening for output of steam passing through a partition having at least one steam passage; and
a frontal contact surface that is at least partially provided for by a circumferential edge of the steam ejection opening, and that is configured to be in grazing contact with a garment when, during use, steam is released from the steam ejection opening onto the garment,
wherein a circumference of the circumferential edge is smaller than a circumference of the partition which is further away from the garment than the circumferential edge of the frontal contact surface,
wherein the steam head further comprises a drainage tube extending apart from the steam duct between a condensate inlet end and a condensate outlet end, and
wherein the condensate inlet end is disposed within the downstream portion of the steam duct.

2. The steam head according to claim 1, wherein the surface area of the frontal contact surface is less than 10% of the area of the steam ejection opening.

3. The steam head according to claim 1, wherein at least a part of the downstream portion of the steam duct has an inner cross-sectional area that decreases in a downstream direction, towards the steam ejection opening.

4. The steam head according to claim 1, wherein the at least one steam passage is disposed at least 2 cm upstream of the steam ejection opening at the downstream end of the steam duct.

5. The steam head according to claim 1, wherein the partition is made of a porous material defining a plurality of microscopic steam passages.

6. The steam head according to claim 1, wherein the condensate outlet end of the drainage tube is fluidly connectable to at least one of a water reservoir, a boiler and a dedicated condensate collector, such that any condensate in the downstream portion of the steam duct may drain back therein.

7. A garment steamer, comprising:
a steam head including:
a handle;
a steam duct, extending through or otherwise connected to the handle, having an upstream portion with an upstream end that is configured to be connected to a steam hose, and a downstream portion with a downstream end that defines a steam ejection opening for output of steam passing through a partition having at least one steam passage; and
a frontal contact surface that is at least partially provided for by a circumferential edge of the steam ejection opening, and that is configured to be in grazing contact with a garment when, during use, steam is released from the steam ejection opening onto the garment,
wherein a circumference of the circumferential edge is smaller than a circumference of the partition which is further away from the garment than the circumferential edge of the frontal contact surface,
wherein the steam head further comprises a drainage tube extending apart from the steam duct between a condensate inlet end and a condensate outlet end, and
wherein the condensate inlet end is disposed within the downstream portion of the steam duct;
a base, accommodating a water reservoir having a water supply opening and a water discharge opening;
a boiler having a water supply opening and a steam discharge opening, wherein the water supply opening of the boiler is connected to the water discharge opening of the water reservoir; and
a steam hose, having a first end connected to the steam discharge opening of the boiler and a second end connected to the steam head,
wherein the condensate outlet end of the drainage tube is fluidly connected to at least one of the water reservoir and the boiler, such that condensate in the downstream portion of the steam duct may drain back therein.

8. The garment steamer according to claim 7, wherein the steam hose and the drainage tube run in parallel within a uni-strand cord that extends between the steam head and the base.

* * * * *